US007249962B2

(12) United States Patent
Milette et al.

(10) Patent No.: US 7,249,962 B2
(45) Date of Patent: Jul. 31, 2007

(54) CONNECTOR ASSEMBLY

(75) Inventors: Luc Milette, Montréal (CA); Michel Bohbot, Montréal (CA)

(73) Assignee: Belden CDT (Canada) Inc., Pointe Claire (CA)

( * ) Notice: Subject to any disclaimer, the term of this patent is extended or adjusted under 35 U.S.C. 154(b) by 0 days.

(21) Appl. No.: 10/986,206

(22) Filed: Nov. 12, 2004

(65) Prior Publication Data

US 2005/0181660 A1 Aug. 18, 2005

Related U.S. Application Data

(60) Provisional application No. 60/519,625, filed on Nov. 14, 2003.

(30) Foreign Application Priority Data

Nov. 14, 2003 (CA) ..... 2449528

(51) Int. Cl.
*H01R 4/24* (2006.01)

(52) U.S. Cl. ..... 439/425; 439/404

(58) Field of Classification Search ..... 439/425, 439/403–405

See application file for complete search history.

(56) References Cited

U.S. PATENT DOCUMENTS 4,820,179 A * 4/1989 Saijo ..... 439/224
4,927,375 A 5/1990 Debortoli et al.
5,226,835 A 7/1993 Baker, III et al.
5,298,680 A * 3/1994 Kenny ..... 174/36
5,350,324 A * 9/1994 Guilbert ..... 439/894
5,460,545 A 10/1995 Siemon et al.
5,601,447 A 2/1997 Reed et al.
5,634,817 A 6/1997 Siemon et al.
5,888,100 A * 3/1999 Bofill et al. ..... 439/676
5,911,594 A 6/1999 Baker, III et al.
5,915,989 A 6/1999 Adriaenssens et al.
6,270,372 B1 8/2001 Jenner et al.
6,354,872 B1 * 3/2002 Lilienthal et al. ..... 439/578
6,379,174 B1 4/2002 Siemon et al.
6,447,326 B1 9/2002 Teach et al.
6,558,204 B1 * 5/2003 Weatherley ..... 439/676
6,761,589 B2 * 7/2004 Venditti et al. ..... 439/596
6,932,640 B1 * 8/2005 Sung ..... 439/405
2003/0139094 A1 7/2003 Venditti et al.

* cited by examiner

*Primary Examiner*—Xuong Chung-Trans
(74) *Attorney, Agent, or Firm*—Goudreau Gage Dubuc

(57) ABSTRACT

A connector assembly for interconnecting an end of a cable comprising one or more twisted pair conductors, each of the conductors enveloped in an insulating covering, with the bifurcated contacts of a connecting block. The assembly comprises an insulated housing and a plurality of non-contacting conductive terminals disposed in the housing. Each of the terminals comprises a blade exposed along a front face of the housing and adapted to be inserted into one of the bifurcated contacts, and a piercing mechanism comprising at least one tooth. Each of the conductors is terminated by one of the terminals, the teeth puncturing the insulated covering of a free end of the conductor thereby bringing the terminal into conductive contact with the conductor.

60 Claims, 7 Drawing Sheets

CONNECTOR ASSEMBLY

The present invention claims the benefit of a commonly assigned provisional application entitled "Connector Assembly", which was filed on Nov. 14, 2003 and assigned Ser. No. 60/519,625. The entire contents of the foregoing provisional patent application are hereby incorporated by reference.

FILED OF THE INVENTION

The present invention relates to a connector assembly. In particular the present invention relates to a connector assembly for interconnecting a cable comprised of a series of insulated conductors with the bifurcated connectors of a connector block.

BACKGROUND OF THE INVENTION

A variety of prior art systems exist for terminating the ubiquitous twisted pair cables used in telecommunication systems with a connector suitable for insertion to a connector block comprised of a series of Insulation Displacement Connectors (IDCs). These prior art systems typically provide, within the connector housing, a means for retaining the cables within the housing, for example by means of collars or the like which, during assembly, encircle the cable thereby hindering its retraction from the connector housing. Additionally, to simplify the assembly of such connectors in the field, the connectors, which are typically of two part construction, typically comprise a series of bifurcated IDC connectors arranged in one side of the connector housing into which the ends of the twisted pairs of conductors can be inserted using a suitable tool. As is known in the art, such IDC connectors slice through the insulating covering of the individual conductors, thereby bringing the conductor into contact with the IDC connector. The IDC connectors are in turn connected to, or form part of, a terminal which is exposed along a front face of the connector, the terminals adapted for insertion into the connector block.

There are also disclosed prior art connectors which provide posts or the like around which the conductors can be arranged thereby improving to some degree the performance of the cable/connector as well as the strength of the assembled cable/connector.

However, the above discussed prior art devices typically untwist a relatively large amount of conductor from each twisted pair in order to align the conductor with and insert it into the provided IDC connector. Additionally, no effort is made in such prior art conductors to ensure that the point of contact between twisted pairs emerging from the exposed end of the cable, at least two of which must typically be crossed in order to be attached in the correct sequence with the IDC connectors, is minimised. Furthermore, the point of insertion of the individual conductors into the IDC connectors is typically arranged along a parallel line, which may give rise to unwanted cross-talk and the like thereby reducing performance of the connectors, especially at high frequencies.

As a result, the above discussed prior art devices are typically unsuitable for use in connectors which must meet the Category 6 performance standards.

SUMMARY OF THE INVENTION

To address the above and other drawbacks of the prior art, there is disclosed a connector assembly for interconnecting an end of a cable comprising one or more twisted pair conductors, each of the conductors enveloped in an insulating covering, with the bifurcated contacts of a connecting block. The assembly comprises an insulated housing and a plurality of non-contacting conductive terminals disposed in the housing. Each of the terminals comprises a blade exposed along a front face of the housing and adapted to be inserted into one of the bifurcated contacts, and a piercing mechanism comprising at least one tooth. Each of the conductors is terminated by one of the terminals, the teeth puncturing the insulated covering of a free end of the conductor thereby bringing the terminal into conductive contact with the conductor.

There is also disclosed a conductive terminal for terminating a conductor enveloped in an insulated covering and providing interconnection with a connector block comprising at least one bifurcated contact. The terminal comprises a contact blade adapted for insertion between the bifurcated contact and a piercing contact mechanism comprising at least one tooth, the tooth adapted for puncturing the insulated covering thereby bringing the terminal into conductive contact with the conductor.

Additionally, there is disclosed a patchcord for interconnecting a first connector block comprising a series of bifurcated connectors with a device. The patchcord comprises a cable comprising at least one twisted pair of conductors and a first connector assembly adapted for interconnecting a first end of the cable with the bifurcated connectors of the first connecting block. The first connector assembly comprises an insulated housing and a plurality of non-contacting conductive terminals disposed in the housing. Each of the terminals comprises a blade exposed along a front face of the housing and adapted to be inserted into one of the bifurcated contacts and a piercing mechanism comprising at least one tooth. Each of the conductors is terminated by one of the terminals, the teeth puncturing the insulated covering of a free end of the conductor thereby bringing the terminal into conductive contact with the conductor.

Furthermore, there is disclosed a wire guide for interposition between an end of a cable, the cable comprised of at least two twisted pairs of conductors, and a plurality of connector terminals, at least two of the twisted pairs crossing between the cable end and the terminals. The wire guide comprises at least two guideways, wherein each of the twisted pairs is inserted into a respective one of the guideways, and wherein the guideways guide each of the twisted pairs such that at a point of intersection the crossing twisted pairs are maintained substantially at right angles.

There is also disclosed a method for adapting an end of a cable comprised of a plurality of twisted pairs of conductors, each of the conductors enveloped in an insulating covering and having a free end, for interconnection with the bifurcated conductors of a connecting block. The method comprises the steps of providing a connector assembly comprising a plurality non-contacting conductive terminals disposed in an insulated housing, each of the terminals comprising a blade exposed along a front face of the housing and adapted for insertion into the bifurcated conductors, and a piercing mechanism having at least one tooth, inserting the free end of each of the conductors into the housing, and, for each terminal/conductor pair, puncturing the insulating covering the free end of each of the conductor with the piercing mechanism teeth thereby bringing the terminal into conductive contact with the conductor.

There is furthermore disclosed a method for adapting an end of a cable comprised of a plurality of twisted pairs of conductors, each of the conductors enveloped in an insulating covering and having a free end, for interconnection with the bifurcated conductors of a connecting block. The method comprises the steps of providing an insulated housing, providing a plurality of terminals, each of the terminals comprised of a blade adapted for insertion into the bifurcated conductors and a piercing mechanism having at least one tooth, and, for each free end, arranging the free end within the housing so the free end is substantially in parallel to the other free ends and, using one of the terminals, puncturing the insulating covering of the free end with the piercing mechanism teeth thereby interconnecting the terminal with the conductor. Once assembled, the blades are exposed along a front face of the housing.

There is additionally disclosed an adaptor for interconnecting a cable terminated with a connector plug comprising a plurality of conductive contacts with the bifurcated contacts of a connecting block. The adaptor comprises an insulated housing, a socket moulded in a first surface of the housing, the socket adapted to receive the connector plug and comprising a plurality of conductive elements disposed therein, wherein when the plug is inserted into the socket the contacts move into electrical contact with the elements, and a plurality of non-contacting conductive terminals disposed in the housing, each of the terminals comprising a blade exposed along a second surface of the housing and adapted to be inserted into one of the bifurcated contacts. Each of the terminals is in conductive contact with one of the conductive elements.

There is also disclosed a connector assembly for interconnecting an end of a cable comprising at least two twisted pair conductors, each of the conductors enveloped in an insulating covering and having a free end, with the bifurcated contacts of a connecting block. The assembly comprises an insulated housing and a plurality of pairs of adjacent non-contacting conductive terminals disposed in the housing, each of the terminals comprising a blade and a conductive strip attached substantially at right angles towards one end of the blade, wherein the blades are exposed along a front face of the housing. Each of the free ends of a twisted pair of conductors is in conductive contact with a second end of the conductive strips of a terminal pair and the conductive strips of adjacent terminal pairs are attached towards different ends of the blades.

DETAILED DESCRIPTION OF THE ILLUSTRATIVE EMBODIMENTS

Figure 1:
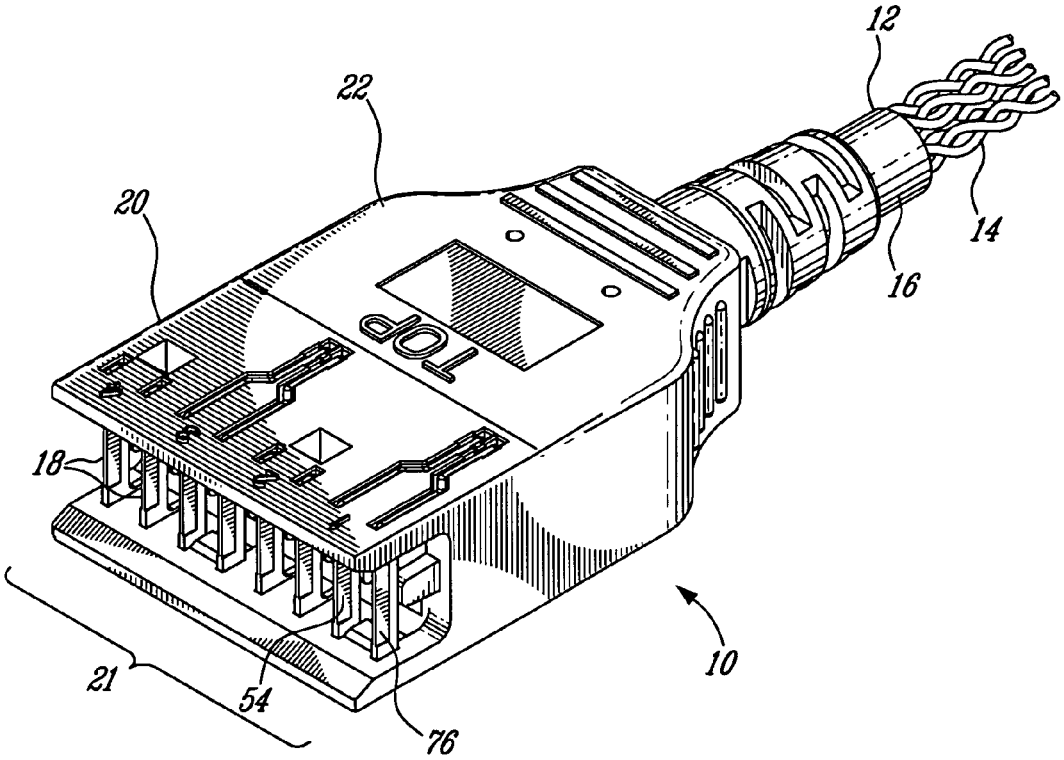
FIG. 1 is a raised front perspective view of a connector assembly in accordance with an illustrative embodiment of the present invention.

Referring to FIG. 1, a connector assembly, generally referred to using the numeral 10, is disclosed. The connector assembly 10 terminates a cable 12 comprised of a series of twisted pairs of conductors 14 covered in an insulating jacket 16 by a series of conductive terminals as in 18 fabricated, for example, from a single piece of rigid conducting material such as stamped phosphor bronze plated with nickel or gold. Each conductor 14 is manufactured, for example, from a conductive material such as of 23 or 24 gauge solid copper wire covered with a suitable dielectric insulating cover, although other gauges and types of conductors, such as stranded conductors, could be used.

The terminals 18 are retained within an insulated housing 20 and exposed along a front face 21 thereof, the housing fabricated, for example, from a non-conductive material such as injection moulded plastic. In the disclosed illustrative embodiment, the multi-conductor cable 12 comprises four (4) twisted pairs of conductors 14 terminated by eight (8) terminals 18, although it will be understood that other configurations would be possible, including those with one, two or three twisted pairs. The housing also illustratively includes an insulted protective covering 22 providing a gripping surface for removing and installing the assembly 10 from/to a connector block (not shown).

Figure 2:
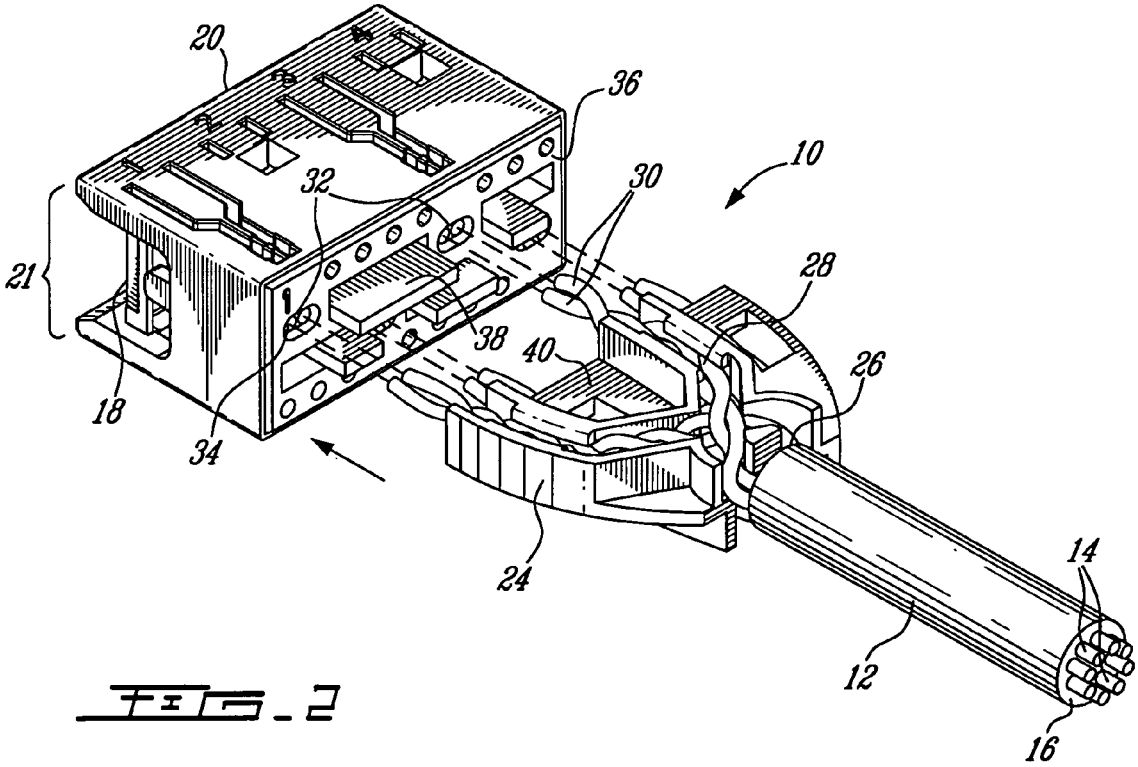
FIG. 2 is an exploded raised rear perspective view of a connector assembly with the cover removed in accordance with an illustrative embodiment of the present invention.

Referring now to FIG. 2, in order to align the twisted pairs of conductors 14 with the correct terminals 18, a wire guide 24 is disposed between the end 26 of the cable jacket 16 and the insulated housing 20. Guideways as in 28, illustratively in the form of channels, in the wire guide 24 separate and guide the twisted pairs of conductors 14 and align the free ends as in 30 of the conductors 14 with a series of pairs as in 32 of conductor accepting apertures 34 moulded in the rearward face 36 of the insulated housing 20.

During assembly, the free end 30 of each conductor 14 is inserted into its respective conductor accepting aperture as in 34 as the wire guide 24 is mounted onto the rearward face rearward face 36 of the insulated housing 20. The spacing between the aperture pair 32 terminating a given twisted pair of conductors 14 is adapted to be substantially the same as the separation between the conductors 14 of the twisted pair in their untwisted state. Additionally, a series of raised bosses 38 mate with corresponding cutaway portions 40 in the wire guide 24 thereby holding it securely to the insulated housing 20.

Figure 3:
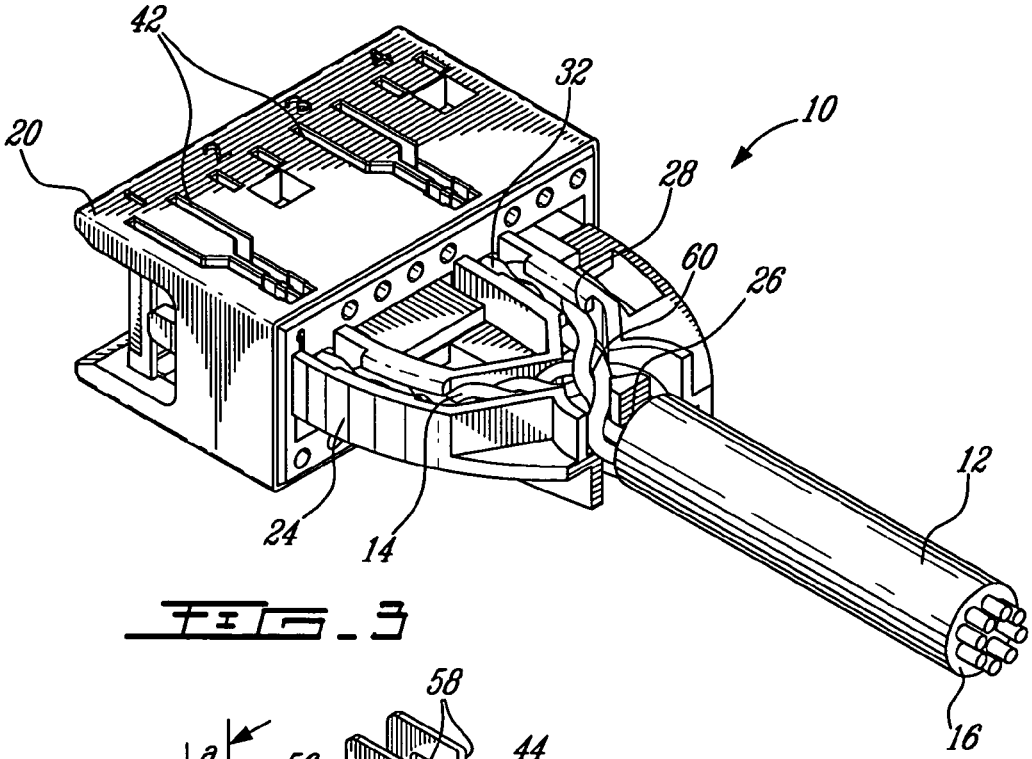
FIG. 3 is an assembled view of the connector of FIG. 2.

Referring to FIG. 3, an insulated housing 20 with a wire guide 24 mounted thereto is shown.

Figure 4:
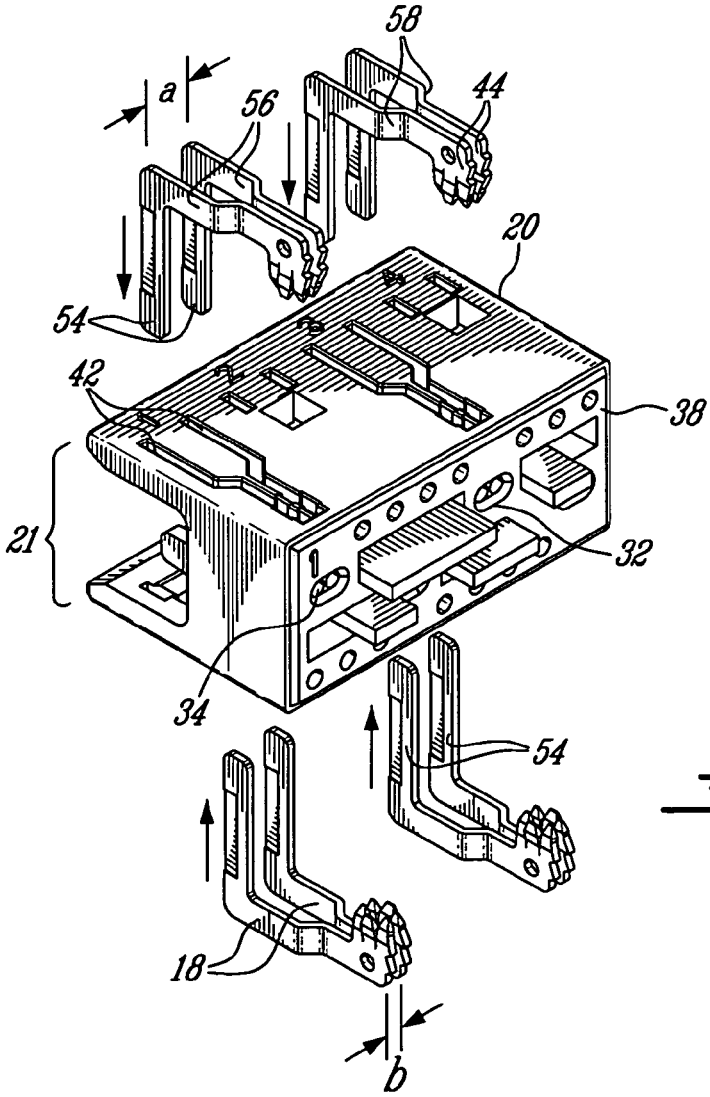
FIG. 4 is an exploded raised rear perspective view of a terminal housing in accordance with an illustrative embodiment of the present invention.

Referring now to FIG. 4 in addition to FIG. 3, once the conductors 14 have been inserted into the insulated housing 20 via the conductor accepting apertures 34, the terminals as in 18 are inserted into the insulated housing 20 via corresponding slots as in 42 moulded into the insulated housing 20, typically using a suitable tool (not shown).

Figure 5:
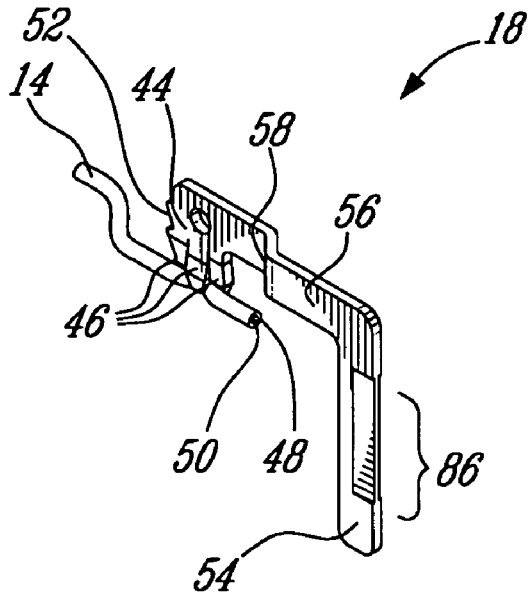
FIG. 5 is a raised rear perspective view of a terminal in accordance with an illustrative embodiment of the present invention.

Referring now to FIG. 5 in addition to FIG. 4, each terminal 18 is comprised at one end of a piercing mechanism 44 (illustratively a tri-point mechanism) comprised of a number of sharp teeth 46. As the terminal 18 is forced into the slot 42, typically by means of a suitable installation tool (not shown), the teeth 46 pierce (or are punched-through) the conductor 14, which is held firmly by an inner surface of the aperture 34, perforating the outer insulating cover 48 from the conductor 14 thereby providing electrical contact between the conductive core 50 and the terminal 18. Provision of this means of assembly means that the connector is suitable for assembly by both automated manufacturing means as well as by a technician in the field. Additionally, the use of the piercing, or punch-through, mechanism 44 for interconnecting each terminal 18 with a conductor 14 ensures that the distance between the individual conductors 14 of the twisted pairs can be rigorously maintained, thereby improving signal quality. Furthermore, the piercing mechanism 44 also ensures that the interconnecting surfaces between conductor 14 and terminal 18 are minimised, thereby reducing the deteriorating effect capacitance may have on any transmitted signals. Also included on each conductive terminal 18 is a securing mechanism 52, illustratively in the form of a serration, which on insertion of the terminal 18 into one of the slots as in 42, grips the housing 20 thereby retaining the terminal 18 within the slot 42.

Still referring to FIG. 5, the piercing mechanism 44 is connected to a terminal blade 54 by a conductive strip 56 which is attached towards one end of the blade 54. Illustratively, the conductive strip 56 is joined substantially at right angles to the blade 54. Referring back to FIG. 4 in addition to FIG. 5, in order to provide that the spacing "b" between the piercing mechanisms 44 of adjacent pairs of terminals 18 is less than the distance "a" between the blades 54 adjacent of adjacent pairs of terminals 18, a crimp as in 58 is, for example, formed in the conductive strips 56.

Still referring back to FIG. 4, the terminals 18 are illustratively arranged in pairs of terminals wherein the conductive strips 56 of adjacent pairs of terminals 18 are attached towards opposing ends of the terminal blades 54 (and as a result, when installed arranged towards opposite sides of the insulated housing 20). In this regard, it is foreseen that the pairs of terminals as in 18 are installed via slots as in 42 wherein the slots of adjacent pairs of terminals as in 18 are accessible through opposite first and second surfaces of the housing 20. Once the terminals have been inserted into their respective slots 42 in the housing 20, the piercing mechanisms 44 of the pairs of terminals 18 are aligned with the apertures 34 in the rear face 36 of the housing 20. In order that the piercing mechanisms 44 are correctly aligned with the apertures 34, the pairs of apertures as in 32 are staggered, with alternating aperture pairs 32 being closer to an opposite side of the housing 20. Arranging the terminals 18 and aperture pairs 32 in this manner permits the integrity of the performance of the cable/connector assembly to be maintained. Indeed, in order to transmit a high performance signal, the quality of the signal is maintained on each conductor of a given twisted pair due to its unique configuration. Different characteristics will determine the transmission performance according to the manner in which the twisted pairs are configured as well as the manner in which the twisted pairs interact with one another. The configuration of where and how the conductors are interconnected with the terminals, including the displacement between adjacent pairs of terminals, is an important aspect. In this regard, the staggering of the apertures 32 as described hereinabove, and therefore the point where the conductors 14 of different twisted pairs are interconnected with the terminals 18, serves to reduce the extent to which terminals 18 terminating a given twisted pair of conductors 14 interfere with other pairs of terminals 18, especially those terminal pairs which would otherwise be adjacent, and therefore in relative proximity.

Referring back to FIG. 3, the shape of the guideways 28 is illustratively selected such that the twisted pairs of conductors 14 terminate opposite their respective aperture pairs 32. Additionally, the guideways 28 guide the conductors 14 such that, for those twisted pairs which must necessarily cross in order to be aligned with their respective aperture pairs 32, the conductors 14 of these twisted pairs are held substantially at right angles at their points of intersection 60. Maintaining the crossing twisted pairs substantially at right angles reduces the interference between the crossing twisted pairs, thereby improving performance of the connector 10 as a whole. Also, as a connector cable 12 is typically terminated at both ends by the same type of connector assembly, the various components, including the wire guide 24, may be used as part of a connector assembly 10 at either end of the cable. Furthermore, a spacer (not shown), for example in the form of a sheath or shrink tube surrounding one of the crossing twisted pairs at least at the point of intersection 60 and illustratively fabricated from a shielding material, can be used to provide increased separation (i.e. a gap) between the crossing twisted pairs and therefore improve performance in terms of mutual interference.

Referring again to FIG. 4, by maintaining a short distance between the rearward face 36 of the insulated housing 20 and the piercing mechanisms 44, and thereby reducing the length of conductor 14 which must be unraveled from its twisted pair prior to insertion into the conductor accepting apertures 34, the signal performance can also be improved. Indeed, as is known to persons of ordinary skill in the art, the transmission of high quality high frequency signals depends to a large part on each conductor 14 of a twisted pair being maintained in a particular configuration. Additionally, the crimp 58 formed in the terminals 18 allows the distance "b" between the piercing mechanisms 44 of a pair of terminals 18, and therefore between the ends (reference 30 in FIG. 2) of the individual conductors 14 of each twisted pair to be optimised (for example, depending on the method of fabrication of the cable 12 which is terminated by the connector assembly 10) while maintaining the predetermined or standardized distance "a" between the blades as in 54 of each terminal 18. For example, in the disclosed illustrative BIX embodiment, a standardized distance is used for "a" between the blades 54 (which are illustratively arranged in parallel, evenly spaced along the front face 21 of the housing 20 and in a manner such that the blades 54 intersect the front face 21 at right angles) of 0.15 inches. On the other hand, the distance "b" between the piercing mechanisms 44 of a pair of terminals 18, and therefore the ends (reference 30 in FIG. 2) of the twisted pairs of conductors (reference 14 in FIG. 2), is 0.04 inches (although this could be varied depending on the type of twisted pair conductors 14 being terminated by the terminal 18).

Note that, in order to reduce the distance "b" such that it is similar or the same to the spacing between the conductors 14 of a given twisted pair, the use of interconnection mechanisms other than the piercing mechanisms 44, such as an IDC connection or a soldered interconnection, typically prove unsuitable. Indeed, both IDC connectors and solder would typically require a much larger displacement "b"

between the terminals of a given pair in order to ensure that the terminals are not touching. Additionally, both IDC connections and soldered connections would typically require a terminal 18 having a much larger surface area at the point of interconnection as compared to the disclosed piercing mechanism 44, which, as discussed above, due to the increased capacitive effects would also have a negative effect on overall performance of the assembled connector 10.

Figure 6:
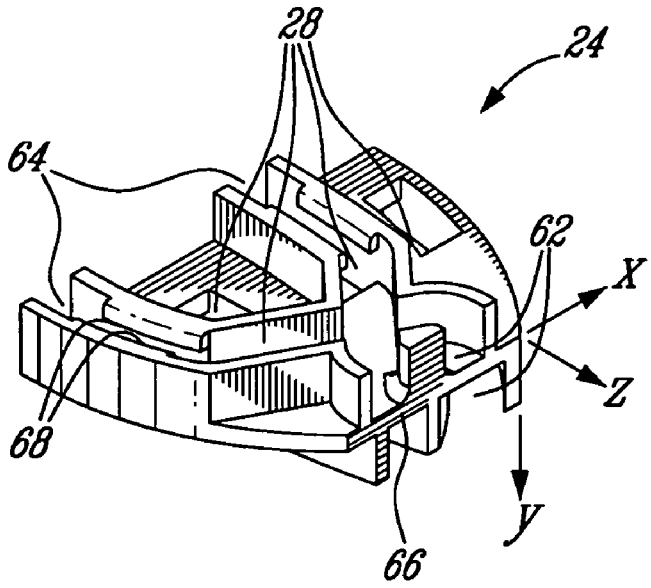
FIG. 6 is a raised rear perspective view of a wire guide in accordance with an illustrative embodiment of the present invention.

Referring now to FIG. 6, a detailed view of a wire guide 24 having four guideways 28 for guiding four twisted pairs of conductors (not shown) is disclosed. Referring to FIG. 3 in addition to FIG. 6, The wire guide 24 ensures that an appropriate separation is maintained between the twisted pairs of conductors 14 between the point where the twisted pairs exit the end 26 of the cable jacket 16 (the guideway inlet as in 62) and where each conductor 14 comes into contact with its respective terminal 18 (the guideway outlet as in 64). In particular, by selecting an appropriate thickness to the substantially flat diving layer 66 dividing the upper and lower guideways as in 28 (the "Y" direction) as well as the relative positions of the inlets 62 into the wire guide 24 (the "X" direction) inductive interaction between the twisted pairs can be minimised thus providing for an improved performance. Additionally, by varying length of the wire guide (the "Z" direction) the distance between where the twisted pairs of conductors 14 exit the end 26 of the cable jacket 16 and the point at which each conductor 14 is attached to a terminal 18 can also be optimised. Furthermore, within each guideway 28 a pair of protrusions 68 are provided for retaining the twisted pair of conductors 14 within the guideway 28 during assembly.

Still referring to FIG. 6, the wire guide can illustratively be fabricated from a dielectric such as plastic or a shielding material.

Figure 7:
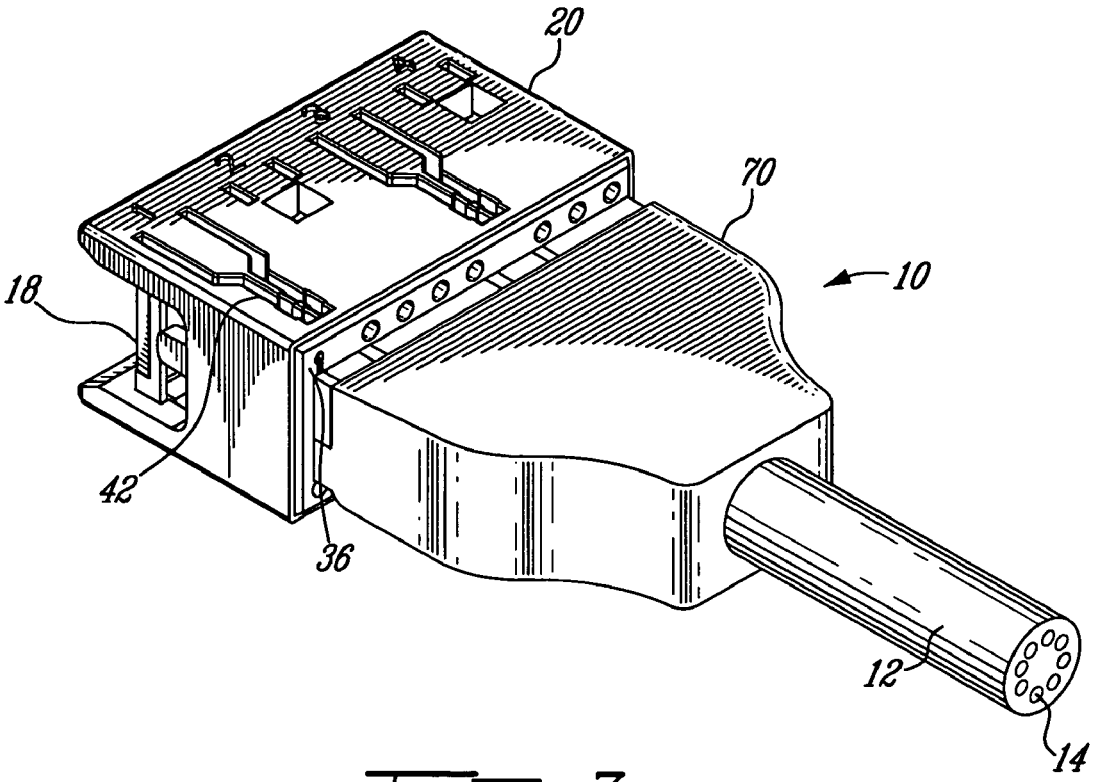
FIG. 7 is a raised rear perspective view of an assembled connector assembly with the insulating cover installed in accordance with an illustrative embodiment of the present invention.

Referring now to FIG. 3 and FIG. 7, once the wire guide 24 is assembled to the rearward face 36 of the insulated housing 20, the individual conductors 14 of the cable 12 fed through their respective apertures (reference 32 on FIG. 2) and the terminals 18 inserted into their respective slots 42, an insulating material 70 is illustratively moulded over the wire guide 24/conductor 14 assembly. The insulating filler material 70 improves the robustness of the resulting assembly and is fabricated for example from a non-conducting material such as plastic. The use of injection moulding, for example, ensures penetration of the cover material into the guideways (channels) 28 filling them completely and thereby binding the conductors 14 within the guideways 28 of the wire guide 24. This in turn ensures that the positions of the twisted pairs of conductors 14 within the wire guide 24 will be strictly maintained, thereby improving the electrical transmission performance of the connector assembly 10 as well as the resulting mechanical strength of the connector assembly 10.

Figure 8:
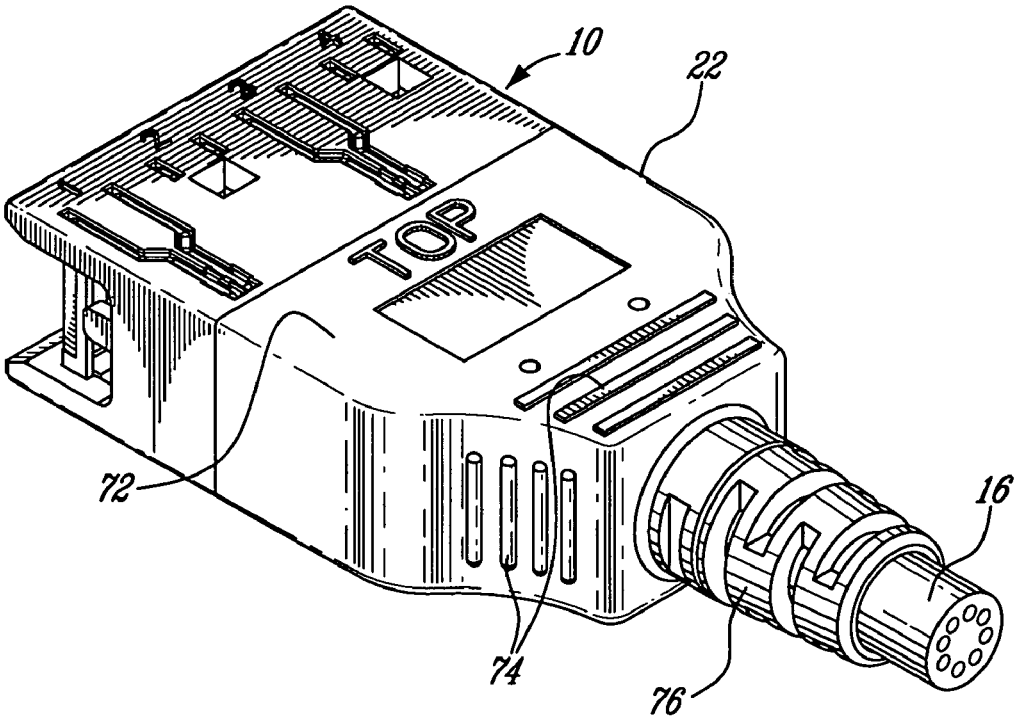
FIG. 8 is a raised rear perspective view of an assembled connector assembly with the outer insulating protective housing installed in accordance with an illustrative embodiment of the present invention.

Referring now to FIG. 8, once wire guide 24 has been covered with the insulating filler material (reference 70 in FIG. 7), the insulating protective cover 22 is then moulded over the insulating material 70. The insulating protective cover 22 is manufactured, for example, from a pliable non-conducting material such as a rubberized plastic or the like. In the surface 72 of the cover 22 a series of gripping ridges 74 are formed to provide an improved grip when the connector assembly 10 is being inserted into or withdrawn from a connector block. The color of the material used to form the outer insulating protective cover 22 may also be varied for a given application. Additionally, and in order to improve the mechanical robustness of the connector/cable interconnection, a reinforcing collar 76 is also moulded between the protective cover 22 and the cable jacket 16.

Figure 9A:
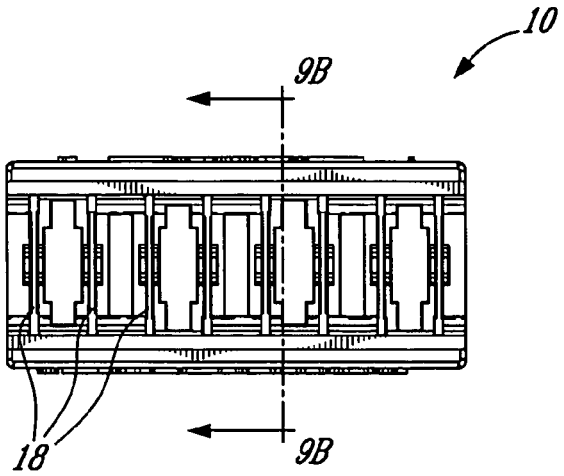
FIG. 9A is a front view of a connector assembly in accordance with an illustrative embodiment of the present invention.
Figure 9B:
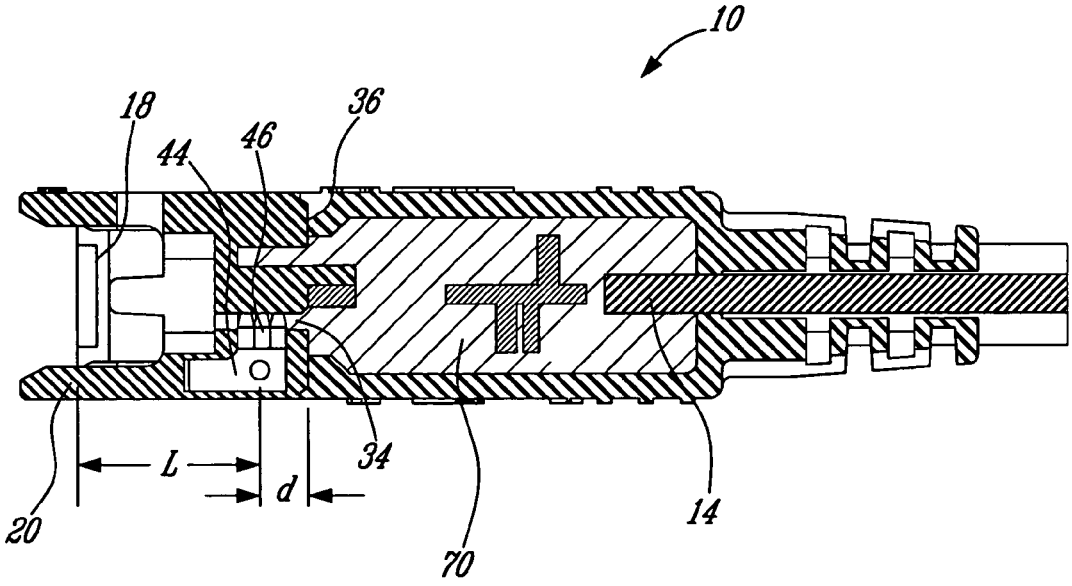
FIG. 9B is a side cut-away view along 9B of the connector assembly in FIG. 9A.

Referring now to FIGS. 9*a* and 9*b*, the assembled connector assembly 10 minimises the distance "d" between the rearward face 36 of the insulated housing 20 and the point at which contact is made between the terminal 18 and the conductor 14 via the teeth 46 of the piercing mechanism 44. Additionally, using the injection moulding technique the twisted pairs of conductors 14 are encased in the plastic of the insulating material 70.

Provided requisite care is taken during the fabrication of the connector assembly, the connector assembly 10 as described is sufficient to meet the performance requirements of Category 6 pursuant to TIA/EIA T-568-B.2-1.

Figure 10:
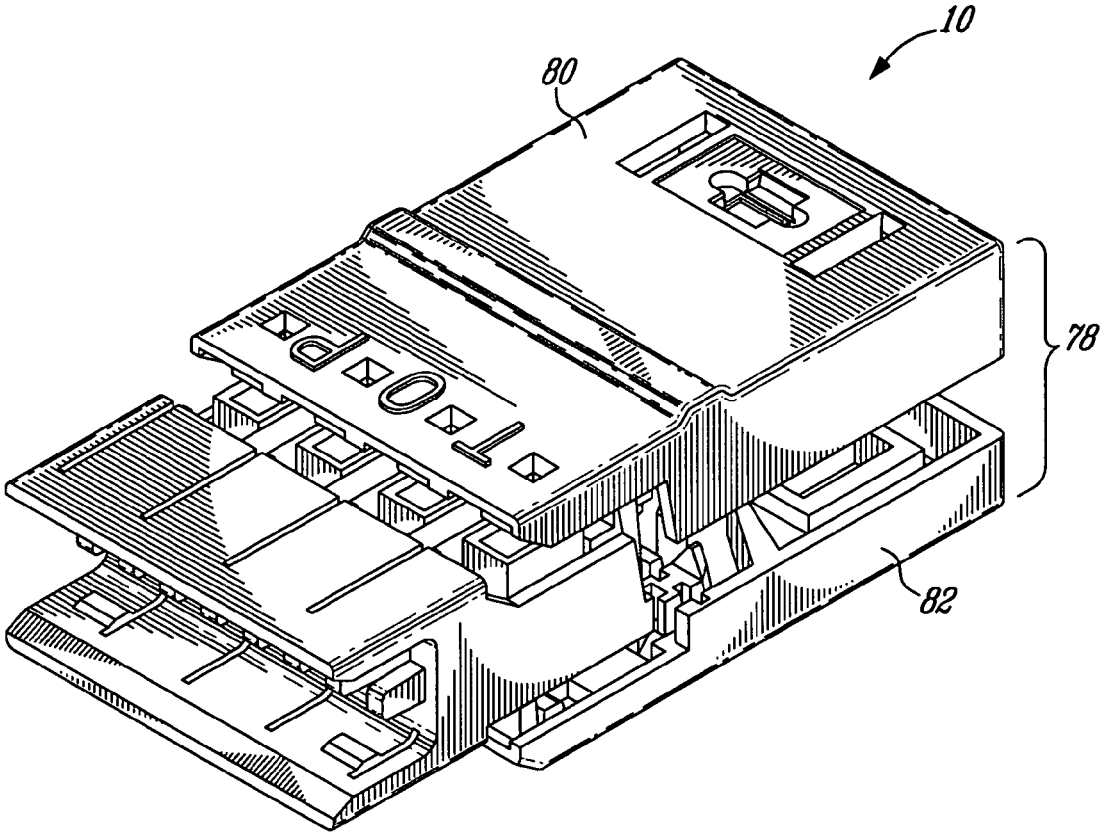
FIG. 10 is a raised side perspective view of a connector assembly in accordance with an alternative illustrative embodiment of the present invention.

Referring to FIG. 10, alternatively the insulating material 70 and outer insulating protective cover 22 of FIG. 7 could be replaced by a suitable cover assembly 78 comprised of a first part 80 and a second part 82 which snap fit together to hold the wire guide and twisted pairs in place.

Figure 11:
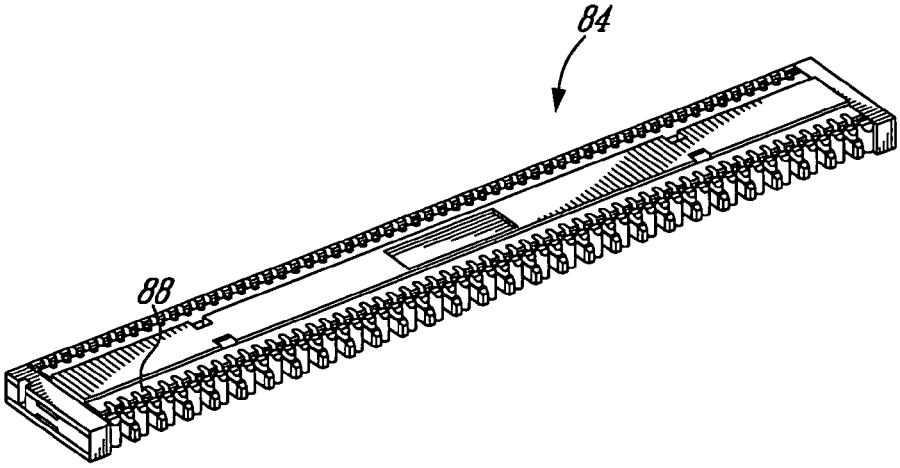
FIG. 11 is a raised front perspective view of a BIX connecting block.

Referring now to FIGS. 1, 5 and 11, one or more connector assemblies 10 are designed to mate with a connecting block 84 by inserting the contact regions (reference 86 on FIG. 5) of the terminal blades (reference 54 on FIG. 5) between a series of bifurcated contact slots 88, for example fabricated from a rigid conducting material such as stamped phosphor bronze plated with nickel or gold. Illustratively, the contact regions (or forward edges) 86 of the blades 54 are chamfered in order to facilitate their insertion between the bifurcated contact slots 88. As will be understood by persons of ordinary skill in the art, multiple connector assemblies 10 can be arranged side by side on a given connecting block 84. Although the connecting block disclosed is that known having the designation BIX, it will be understood by persons of ordinary skill in the art that a variety of other connecting blocks may also be used, for example those known in the art as 110 cross connector blocks or KRONE.

Still referring to FIGS. 1 and 11, in an alternative embodiment the connector assembly 10 and cable 12 of the present invention could assembled with a second connector assembly 10 mounted on a second end of the cable 12 resulting in a patchcord (not shown) suitable, for example, for interconnecting two connector blocks as in 84, or different series of bifurcated contact slots as in 88 on the same connector block 84. Additionally, a connector assembly as in 10 could be assembled to the first end of a cable 12 with a device mounted on the second end of the cable 12, for example an RJ-45 plug or the like, providing a patchcord allowing a connector block 84 to be interconnected with a standard RJ-45 socket or the like. Alternatively, a device such as an electronic testing apparatus could be attached directly to the second end of the cable 12. Also, the conductors 14 at the second end of the cable 12 could be exposed and inserted directly into the bifurcated contact slots 86 of a connector block 84.

In an alternative illustrative embodiment of the present invention, one or more of the terminal blades 54 are adapted to move perpendicularly relative to the front face 21 of the housing 20, with the movable blades 54 being normally biased (for example using an insulated spring or the like) towards the front face 21. Such a configuration would be useful, for example, in a test setting where a connector 10 is repeatedly connected to and then removed from a contact slot as in 88. Although both the terminal blades 18 and the bifurcated contact slots 88 are both designed to endure a number of insertions and removals, repeated insertion and removal will eventually cause either the terminal blades 18, the bifurcated contact slots 88 or both to fail. Providing for the movable blades 54 allows, for example, the terminals 18 to make contact with the bifurcated contact slots 88 without being inserted between the bifurcated contact slots 88, thereby reducing the wear and tear.

Figure 12:
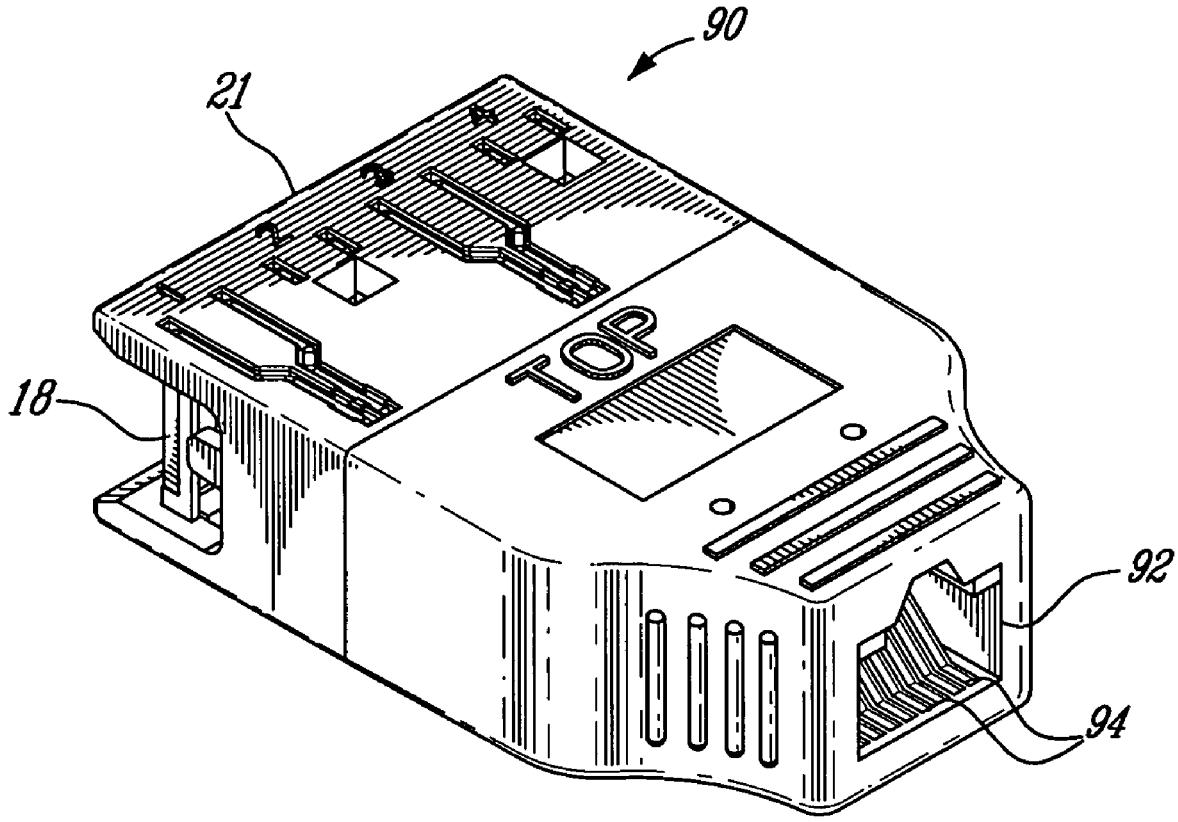
FIG. 12 is an adaptor in accordance with an alternative illustrative embodiment of the present invention.

Referring to FIG. 12, in a second alternative illustrative embodiment the connector assembly can be modified to provide an adaptor as in 90 suitable for interconnecting the connector block 84 of FIG. 11 with, for example, a cable terminated with an RJ-45 plug or the like. In this regard, the adaptor 90 comprises a socket 92 moulded in a first rear surface thereof having a plurality of conductive elements as in 94 mounted therein. Each of the conductive elements as in 94 are interconnected with a respective one of the terminals as in 18 exposed along a front face 21 of the adaptor 90. Insertion of cable terminated with an appropriate plug (both not shown) into the socket 92 brings the conductors of the cable (again, not shown) into contact with a respective one of the elements as in 94 and as a result, the terminals as in 18. A person of ordinary skill of the art will now appreciate that an adaptor 90 equipped with a suitable socket 92 can be used to terminate a cable equipped with a plug of a different type with, for example, the connector block 84 of FIG. 11. Although not shown, a person of ordinary skill in the art will also appreciate that, if twisted pairs of conductors are used to interconnect the elements 94 with the terminals 18, the wire guides, terminals, etc., as discussed hereinabove could also be used to advantage, thereby ensuring that the adaptor 90 meets Category 6 performance requirements.

Although the present invention has been described hereinabove by way of an illustrative embodiment thereof, this embodiment can be modified at will without departing from the spirit and nature of the subject invention.

What is claimed is:

1. A connector assembly for interconnecting an end of a cable comprising at least one twisted pair of conductors, each of the conductors enveloped in an insulating covering, with the bifurcated contacts of a connecting block, the assembly comprising:

an insulated housing; and a plurality of non-contacting conductive terminals disposed in said housing, each of said terminals comprising a blade exposed along a front face of said housing and adapted to be inserted into one of the bifurcated contacts and a piercing mechanism comprising at least one tooth;

wherein each conductor of the at least one twisted pair of conductors is terminated by one of an adjacent pair of said terminals, said teeth puncturing the insulated covering of a free end of the conductor thereby bringing said terminal into conductive contact with the conductor and further wherein a spacing of said piercing mechanisms of said adjacent pair of terminals is less than a spacing of said blades of said adjacent pair of terminals.

2. The connector assembly of claim 1, wherein said blades are arranged in parallel and evenly spaced.

3. The connector assembly of claim 2, wherein said front face is substantially flat and said blades intersect said flat face substantially at right angles.

4. The connector assembly of claim 3, wherein said front face is adapted and said blades are spaced for interconnection with a BIX type connection block.

5. The connector assembly of claim 3, wherein said front face is adapted and said blades are spaced for interconnection with a 110 type connection block.

6. The connector assembly of claim 3, wherein said front face is adapted and said blades are spaced for interconnection with a KRONE type connection block.

7. The connector assembly of claim 1, wherein said blades comprise a chamfered forward edge.

8. The connector assembly of claim 1, wherein said piercing mechanism is a tri-point mechanism.

9. The connector assembly of claim 1, wherein each of said terminals is fabricated from a single piece of conductive material.

10. The connector assembly of claim 1, wherein said blades are fabricated from nickel plated phosphorous bronze.

11. The connector assembly of claim 1, wherein said blades are adapted for movement in a direction perpendicular to said front face.

12. The connector assembly of claim 11, further comprising a biasing mechanism for biasing said blades towards said front face.

13. The connector assembly of claim 1, wherein the assembly meets category 6 performance specifications.

14. The connector assembly of claim 1, wherein each of said terminals further comprises a conductive strip interconnecting said blade and said piercing mechanism.

15. The connector assembly of claim 14, wherein said conductive strip is attached to an end of said blade.

16. The connector assembly of claim 15, wherein the cable comprises at least two twisted pairs of conductors and wherein adjacent pairs of terminals are arranged such that said conductive strips are attached at opposite ends of said blades.

17. The connector assembly of claim 1, wherein the cable comprises at least two twisted pairs of conductors.

18. The connector assembly of claim 17, wherein the cable comprises four twisted pairs of conductors.

19. The connector assembly of claim 17, wherein at least two of said twisted pairs cross one another between the cable end and said terminals and further comprising a wire guide between the cable end and said plurality of conductive terminals, said guide comprised of a plurality of guideways, one guideway for guiding each of the twisted pairs such that, at a point of intersection, the crossing twisted pairs are substantially at right angles.

20. The connector assembly of claim 19, further comprising a spacer between the crossing twisted pairs at said point of intersection.

21. The connector assembly of claim 20, further comprising a spacer between the crossing twisted pairs at said point of intersection.

22. The connector assembly of claim 21, wherein said spacer comprises a shrink tube surrounding at least one of the twisted pairs.

23. The connector assembly of claim 21, wherein said spacer is fabricated from a shielding material.

24. The connector assembly of claim 19, wherein said guideways are channels.

25. The connector assembly of claim 24, wherein the twisted pairs are retained in said channels by a filler material.

26. The connector assembly of claim 25, wherein said filler material is plastic.

27. The connector assembly of claim 19, wherein said guideways each comprise an inlet and an outlet and wherein a spacing and positioning of said inlets relative to one another is adapted to substantially maintain a spacing and positioning of the twisted pairs as they exit the end of the cable.

28. The connector assembly of claim 27, wherein said insulated housing further comprises a series of apertures in a rear face thereof arranged in pairs, each of said pairs positioned at one of said guideway outlets.

29. The connector assembly of claim 1, wherein said insulated housing further comprises a series of apertures in a rear face thereof arranged in pairs, each pair of said apertures adapted for receiving the conductor free ends of a twisted pair, and wherein a spacing between each aperture of an aperture pair is substantially the same as said piercing mechanism spacing.

30. The connector assembly of claim 29, wherein said pairs of apertures are evenly distributed between along said rear face.

31. The connector assembly of claim 30, wherein alternating ones of said aperture pairs are staggered along said rear face.

32. The connector assembly of claim 1, wherein each of said terminals further comprises a securing mechanism for retaining said terminal in said housing.

33. The connector assembly of claim 32, wherein said securing mechanism comprises a serration which grips said housing.

34. A method for adapting an end of a cable comprised of at least one twisted pair of conductors, each of the conductors enveloped in an insulating covering and having a free end, for interconnection with the bifurcated conductors of a connecting block, the method comprising the steps of:

providing a connector assembly comprising at least one adjacent pair of non-contacting conductive terminals disposed in an insulated housing, each of said pair of terminals comprising a blade exposed along a front face of said housing and adapted for insertion into the bifurcated conductors, and a piercing mechanism having at least one tooth, wherein a spacing of said piercing mechanisms of said adjacent pair is less than a spacing of said blades of said adjacent pair;

inserting the free end of each of the conductors into said housing; and for each terminal/conductor pair, puncturing the insulating covering the free end of each of the conductor with said piercing mechanism teeth thereby bringing said terminal into conductive contact with the conductor.

35. The method of claim 34, wherein each of said piercing mechanisms is a tri-point mechanism.

36. The method of claim 34, wherein at least two of the twisted pairs of conductors cross between the cable end and said terminals, and further comprising the step of retaining the crossing twisted pairs at a point of intersection substantially at right angles.

37. The method of claim 36, further comprising the step of maintaining a gap between the crossing twisted pairs at said point of intersection.

38. The method of claim 36, wherein said gap maintaining step comprises covering at least one of the crossing twisted pairs at least at said point of intersection in a sheath.

39. The method of claim 36, further comprising the steps of placing a wire guide between said cable end and said connector assembly, said wire guide comprised of a plurality of guideways, and inserting one of said twisted pairs in a respective one of said guideways, said guideways guiding the twisted pairs such that the crossing twisted pairs are maintained substantially at right angles at a point of intersection.

40. The method of claim 39, wherein each of said guideways comprises a channel and further comprising the step following said inserting step of filling said channels with a channel filler material.

41. The method of claim 34, wherein said insulated housing is comprised of a first part and a second part, said first part adapted to be assembled with said second part.

42. The method of claim 41, wherein prior to said puncturing step said terminals are arranged in said first part and the conductors are arranged in said second part of said housing, and wherein said puncturing step comprises assembling said parts wherein, during assembly, said piercing mechanisms puncture said insulated coverings thereby interconnecting each of said terminals with a respective one of the conductors.

43. A method for adapting an end of a cable comprised of a plurality of twisted pairs of conductors, each of the conductors enveloped in an insulating covering and having a free end, for interconnection with the bifurcated conductors of a connecting block, the method comprising the steps of:

providing an insulated housing;

providing a pair of terminals for each twisted pair of conductors, each of said pair of terminals comprised of a blade adapted for insertion into the bifurcated conductors and a piercing mechanism having at least one tooth, wherein a spacing of said piercing mechanisms of said pair of terminals is less than a spacing of said blades of said pair of terminals; and for each free end, arranging the free end within said housing so the free end is substantially in parallel to the other free ends and, using one of said terminals, puncturing the insulating covering of the free end with said piercing mechanism teeth thereby interconnecting said terminal with the conductor;

wherein once assembled, said blades are exposed along a front face of said housing.

44. The method of claim 43, wherein each of said piercing mechanisms is a tri-point mechanism.

45. The method of claim 43, wherein said housing further comprises a series of guideways accessible through a rearward face of said housing, and said arranging step comprises inserting the free end into a respective guideway.

46. The method of claim 45, wherein said housing further comprises a series of slots accessible through a first surface of said housing, one of said slots intersecting each of said guideways, and wherein said puncturing step comprises inserting one of said terminals into one of said slots.

47. The method of claim 46, wherein said first surface is substantially perpendicular to said front face and said rearward face.

48. The method of claim 46, wherein each of said terminals further comprises a securing mechanism and said puncturing step further comprises retaining said terminal in said slot.

49. The method of claim 48, wherein said securing mechanism comprises a serration and said retaining step comprises embedding said serrations in said housing.

50. The method of claim 46, wherein said housing further comprises a second series of guideways accessible through said rearward face and a second series of slots accessible through a second surface of said housing, one of said second series of slots intersecting each of said second series of guideways, and wherein said puncturing step further comprises inserting one of said terminals into each of said second series of slots.

51. The method of claim 50, wherein said housing is generally box shaped and said second surface is arranged opposite to said first surface.

52. The method of claim 43, wherein at least two of the twisted pairs of conductors cross between the cable end and said terminals, and further comprising the step of retaining the crossing twisted pairs at a point of intersection substantially at right angles.

53. The method of claim 52, further comprising the step of maintaining a gap between the crossing twisted pairs at said point of intersection.

54. The method of claim 53, wherein said gap maintaining step comprises covering at least one of the crossing twisted pairs at least at said point of intersection in a sheath.

55. A connector assembly for interconnecting an end of a cable comprising at least two twisted pair conductors, each of the conductors enveloped in an insulating covering and having a free end, with the bifurcated contacts of a connecting block, the assembly comprising:

an insulated housing; and a plurality of pairs of adjacent non-contacting conductive terminals disposed in said housing, each of said terminals comprising a blade and a conductive strip comprising a first end attached substantially at right angles towards one end of said blade and a second end comprising a piercing mechanism for puncturing the insulated covering of one of the conductor free ends, wherein said blades are exposed along a front face of said housing and wherein a spacing of said piercing mechanisms of said adjacent pair of terminals is less than a spacing of said blades of said adjacent pair of terminals;

wherein each of the free ends of a twisted pair of conductors is in conductive contact with a second end of said conductive strips of a terminal pair, and wherein the conductive strips of adjacent terminal pairs are attached towards different ends of said blades.

56. The connector assembly of claim 55, wherein said blades are arranged in parallel and evenly spaced.

57. The connector assembly of claim 56, wherein said front face is substantially flat and said blades intersect said flat face substantially at right angles.

58. The connector assembly of claim 55, wherein each of said piercing mechanisms comprises at least one tooth formed in each of said second ends of said conductive strips, said teeth puncturing the insulated covering of said conductor free ends thereby bringing said terminals into conductive contact with the conductors.

59. The connector assembly of claim 55, wherein at least two of said twisted pairs cross one another between the cable end and said terminals and further comprising a wire guide between the cable end and said plurality of conductive terminals, said guide comprised of a plurality of guideways, one guideway for guiding each of the twisted pairs such that, at a point of intersection, the crossing twisted pairs are substantially at right angles.

60. The connector assembly of claim 55, wherein the assembly meets category 6 performance specifications.

* * * * *